United States Patent [19]

Nebzydoski

[11] 3,951,973

[45] Apr. 20, 1976

[54] DI AND TRI (HYDROCARBYLAMMONIUM) TRITHIOCYANURATE

[75] Inventor: John W. Nebzydoski, Fishkill, N.Y.

[73] Assignee: Texaco Inc., New York., N.Y.

[22] Filed: June 24, 1974

[21] Appl. No.: 482,545

Related U.S. Application Data

[62] Division of Ser. No. 417,153, Nov. 19, 1973, Pat. No. 3,849,319.

[52] U.S. Cl. ..... 260/248 CS; 252/47

[51] Int. Cl.[2] ..... C07D 251/38

[58] Field of Search ..... 260/248 CS

[56] References Cited

UNITED STATES PATENTS 2,725,379 11/1955 Bernstein et al. ..... 260/248

*Primary Examiner*—John M. Ford

*Attorney, Agent, or Firm*—T. H. Whaley; C. G. Ries; James J. O'Loughlin

[57] ABSTRACT

Di- and tri-$C_8$-$C_{24}$ hydrocarbyl ammonium trithiocyanurate and a lubricating oil composition containing said di- or tri- hydrocarbylammonium thithiocyanurate having improved load carrying properties.

7 Claims, No Drawings

DI AND TRI (HYDROCARBYLAMMONIUM) TRITHIOCYANURATE

This is a division of application Ser. No. 417,153, filed Nov. 19, 1973, now U.S. Pat. No. 3,849,319.

BACKGROUND OF THE INVENTION

1. Field of the Invention

This invention relates to a novel hydrocarbylammonium trithiocyanurate produced by combining 2 to 3 moles of a $C_8$ to $C_{24}$ hydrocarbylamine with trithiocyanuric acid. These compounds can be described as the di-and trihydrocarbylamine salts of trithiocyanuric acid.

The di- and trihydrocarbylammonium trithiocyanurates are represented by the following formula:

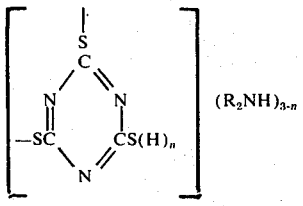

in which R represents hydrogen or a hydrocarbyl radical having from 6 24 carbon atoms at least one R being a hydrocarbyl radical and *n* has a value from 0 to 1.

This invention also relates to a novel lubricating oil composition containing the above-described hydrocarbylammonium trithiocyanurate.

SUMMARY OF THE INVENTION

In general, the di-and trihydrocarbylammonium trithiocyanurates are represented by the following formula:

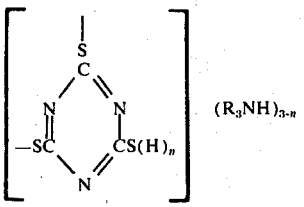

in which R is hydrogen or a hydrocarbyl radical having from 6 to 24 carbon atoms at least one R being a hydrocarbyl radical and *n* has a value from 0 to 1. The so defined hydrocarbylammonium trithiocyanurates result from the combination of from 2 to 3 moles of a hydrocarbylamine with trithiocyanuric acid. Hydrocarbylammonium trithiocyanurates formed from 1 mole of a hydrocarbylamine and a mole of trithiocyanuric acid are not suitable for the purpose to which the present invention is directed and are outside the scope of this invention.

A preferred class of compounds within the scope of this invention are the hydrocarbylammonium trithiocyanurates represented by the following formula:

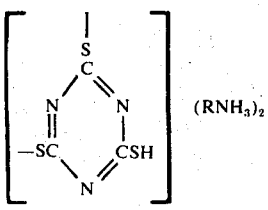

in which R is a hydrocarbyl radical having from about 12 to about 22 carbon atoms.

Another preferred class of hydrocarbylammonium trithiocyanurates are represented by the formula:

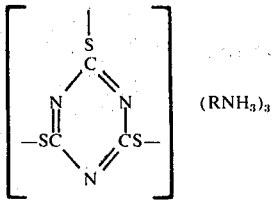

in which R is a hydrocarbyl radical having from about 12 to about 22 carbon atoms. The hydrocarbyl radicals represented by R in all of the formulas above are monovalent hydrocarbyl or hydrocarbon radicals and include alkyl, aralkyl, aryl, alkaryl and cycloalkyl radicals having the prescribed carbon chain length.

A more preferred hydrocarbylammonium trithiocyanurate is that formed from tertiary alkyl primary amines wherein 2 or 3 moles of a teriary alkyl primary amine has been reacted with trithiocyanuric acid.

The hydrocarbylammonium trithiocyanurates are conveniently prepared in a 2-step process beginning with cyanuric chloride. In the first step of this process, cyanuric chloride and thiourea are reacted in the presence of an inert solvent at a moderate temperature, generally the reflux temperature of the solvent to produce a solid reaction product. The solid product is filtered off and dissolved in an alkali solution, such as an aqueous potassium hydroxide solution, which is then acidified with a mineral acid, such as concentrated hydrochloric acid, to produce cyanuric acid, a pale yellow solid having a melting point of >300°C. The general procedure is given in the "Canadian Journal of Chemistry" 44 829 (1966). This reaction is illustrated by the following formula:

(1)

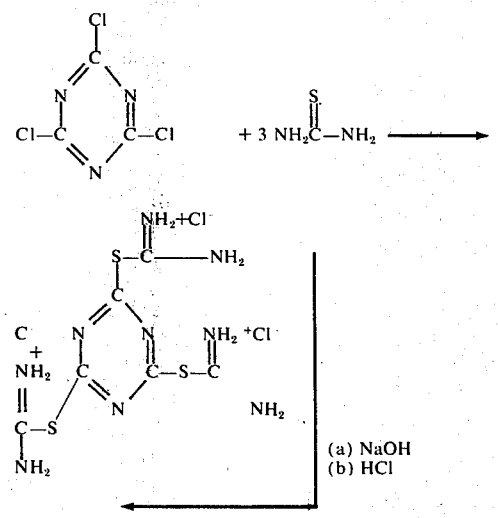

JWN 11/6/73

(2)

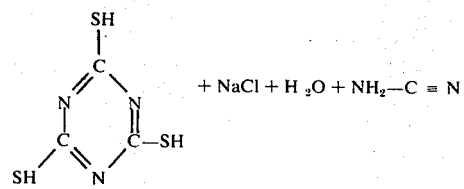

In the second step of the process, trithiocyanuric acid and 2 to 3 moles of a hydrocarbylamine per mole of trithiocyanuric acid are reacted as illustrated by the following formula:

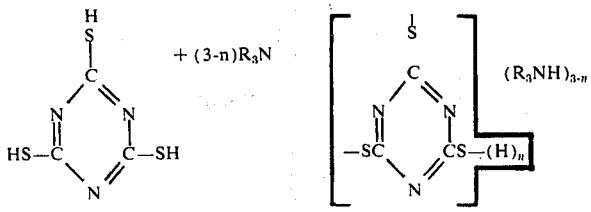

where $n$ equals 0 or 1.

The reactants are heated at an elevated temperature ranging up to 220° to 260°F. with adequate stirring. On completion of this reaction, the product is diluted with methanol or ethanol, filtered, and the salt recovered from the hydrocarbon solvent generally in the form of a yellow oil.

As indicated above, the hydrocarbylammonium trithiocyanurate employed in this invention will contain 2 to 3 moieties of the hydrocarbylamine per mole of the trithiocyanuric acid moiety. The hydrocarbylamine is represented by the formula $RNH_2$ in which R represents a hydrocarbyl radical having from 8 to 24 carbon atoms. Preferred amines are those in which R is a hydrocarbyl radical having from about 12 to 22 carbon atoms. The hydrocarbyl radical can be any monovalent organic radical, such as an alkyl, aryl, cycloalkyl, alkaryl or aralkyl hydrocarbon radical of the indicated carbon chain length. The alkyl radical can be a straight-chain or branched-chain hydrocarbon radical although it is preferred to employ amines in which the hydrocarbyl radical is a tertiary alkyl saturated hydrocarbon radical.

The following examples illustrate the preparation of typical hydrocarbylammonium trithiocyanurates according to this invention.

DESCRIPTION OF THE PREFERRED EMBODIMENTS

EXAMPLE I

Tri(t-$C_{18}$ to $C_{22}$ primary ammonium) trithiocyanurate 18.45 parts of cyanuric chloride, 22.8 parts of thiourea and 400 parts of acetone were refluxed for 2 hours. The solid product was filtered off and dissolved in 170 parts of potassium hydroxide solution (115 grams $H_2O$/20 grams KOH). This mixture was acidified to a pH of 1 with concentrated hydrochloric acid yielding as product a pale yellow solid having a melting point greater than 300°C. The infrared spectrum of this sample was taken and found to be identical to that of an authentic sample.

5.31 parts of trithiocyanuric acid and 28.4 parts of t-$C_{18}$ to $C_{22}$ alkyl primary amine were heated for about 2 hours at 220°F. with stirring. The reaction mixture was cooled, diluted with 50 parts of methanol, filtered and concentrated yielding the product as a yellow oil. This product conformed to the following formula:

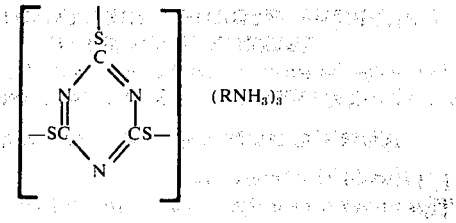

in which R represents a t-$C_{18}$ to $C_{24}$ aliphatic hydrocarbon radical. This salt had a nitrogen content of 7.6% (calc. 7.6) and a sulfur content of 8.4% (calc. 8.6).

EXAMPLE II

Tri(t-$C_{11}$ -$C_{14}$ alkyl primary ammonium) trithiocyanurate 2.95 parts of trithiocyanuric acid and 9.55 parts of t-$C_{11}$ -$C_{14}$ primary alkylamine were heated for about 2 hours at about 250°F. with stirring. The reaction product was cooled, diluted with ethanol, filtered and concentrated yielding 11.9 parts of tri(t-$C_{11}$ -$C_{14}$ alkyl primary ammonium) trithiocyanurate as a yellow oil. This product has a nitrogen content of 11.7% (calc. 12.0).

EXAMPLE III

Di-(t-$C_{18}$ -$C_{22}$ alkyl primary ammonium) trithiocyanurate 5.31 parts of trithiocyanuric acid and 18.9 parts of t-$C_{18}$ -$C_{22}$ alkyl primary amine were reacted as in Example I above to form di(t-$C_{18}$ -$C_{22}$ alkyl primary ammonium) trithiocyanurate having a nitrogen content of 9.6 (calc. 8.7) and a sulfur content of 11.5 (calc 11.9).

Many other oil-soluble di- and trihydrocarbylamamonium trithiocyanurates can be prepared within the scope of this invention following the above procedure which are useful for enhancing the load-carrying properties of a lubricating oil composition. Additional examples of these compounds include di- and tri(octadecylammonium) trithiocyanurate, di- and tri-(trioctadecyl-ammonium) trithiocyanurate, di- and tri-(dioctadecyl ammonium) trithiocyanurate, di- and tri-(di-t-$C_{11}$ -$C_{14}$ alkyl ammonium) trithio cyanurate, di- and tri- (tri-t-$C_{11}$ -$C_{14}$ alkylammonium) trithiocyanurate, di- and tri- (hexadecylammonium) trithiocyanurate, di- and tri-(decylammonium) trithiocyanurate, di- and tri-(eicosylammonium) trithiocyanurate, di- and tri-(dodecylammonium) trithiocyanurate, and di- and tri-(octylammonium) trithiocyanurate.

The di- and tri-(hydro carbylammonium) trithiocyanurates of this invention are valuable for enhaving enhancing load-carrying properties of lubricating oils. In general, the prescribed compounds can be employed in both mineral and synthetic lubricating oil compositions usually at a concentration ranging from about 0.001 to about 0.5 weight percent with the preferred concentration being from about 0.01 to 0.3 percent. A suitable mineral lubricating oil base will have an SUS viscosity at 100°F. ranging from about 50 to 1000 with the preferred viscosity range being from 70 to 300 SUS at 100°F.

The prescribed additive compounds of this invention are particularly efficacious in synthetic ester base lubricating oil compositions and were employed in a typical fully formulated synthetic ester base lubricating oil which was tested for its load-carrying properties as well as for its oxidation-corrosion resistance.

The base fluid component of this type lubricant is an ester-base fluid prepared from pentaerythritol or trimethylolpropane and a mixture of hydrocarbyl monocarboxylic acids. Polypentaerythritols, such as dipentaerythritol, tripentaerythritol and tetra-pentaerythritol can also be employed in the reaction to prepare the base oil.

The hydrocarbon monocarboxylic acids which are used to form the ester-base fluid include the straight-chain and branched-chain aliphatic acids, cycloaliphatic acids and aromatic acids as well as mixtures of these acids. The acids employed have from about 2 to 18 carbon atoms per molecule, and preferably from about 5 to 10 carbon atoms. Examples of suitable specific acids are acetic, propionic, butyric, valeric, isovaleric, caproic, decanoic, cyclohexanoic, benzoic acid, phenylacetic, tertiary-butylacetic acid and 2-ethylhexanoic acid.

In general, the acids are reacted in proportions leading to a completely esterified pentaerythritol or trimethylolpropane with the preferred ester bases being the pentaerythritol tetraesters. Examples of such commercially available tetraesters include pentaerythritol tetracaproate, which is prepared from purified pentaerythritol and crude caproic acid containing other $C_{5-10}$ monobasic acids. Another suitable tetraester is prepared from a technical grade pentaerythritol and a mixture of acids comprising 38 percent valeric, 13 percent 2-methyl pentanoic, 32 percent octanoic and 17 percent pelargonic acids. Another effective ester is the triester of trimethylolpropane in which the trimethylolpropane is esterified with a monobasic acid mixture consisting of 2 percent valeric, 9 percent caproic, 13 percent heptanoic, 7 percent octanoic, 3 percent caprylic, 65 percent pelargonic and 1 percent capric acids. Trimethylolpropane triheptanoate is also a suitable ester base.

The ester base comprises the major portion of the fully formulated synthetic ester base lubricating oil composition. In general, this ester base fluid is present in concentrations from about 90 to 98 percent of the composition.

In addition to the essential di- or tri- (hydrocarbylammonium) trithiocyanurate component of the lubricating oil composition, synthetic ester base lubricants will generally contain additional additives to impart oxidation and corrosion resistance, metal deactivators and the like in order to provide a superior lubricant composition.

A valuable oxidation and corrosion inhibitor is an alkyl or alkaryl phenyl naphthylamine represented by the formula:

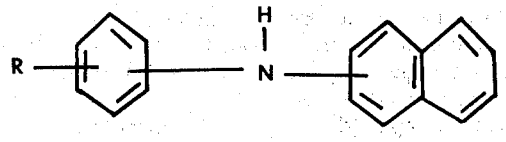

in which R is an alkyl or alkaryl radical having from about 3 to 12 carbon atoms. This radical can be a straight or branched chain alkyl radical with the tertiary alkyl structure being preferred or it can be an alkylaryl radical. The naphthylamine can be either an alpha or beta naphthylamine. Specific effective compounds of this class include N-(p-t-octylphenyl)-$\alpha$-naphthylamine, N-(4-cumylphenyl)-6-cumyl-$\beta$-naphthylamine N-(p-t-octylphenyl)-$\beta$-naphthylamine and the corresponding p-t-dodecylphenyl, p-t-butylphenyl, and p-dodecylphenyl-$\alpha$ and -$\beta$ -naphthylamines. The preferred naphthylamines are those in which R is a tertiary alkyl radical having from 6 to 10 carbon atoms with the preferred concentration of this component being from about 0.5 to 2.5 percent.

Another valuable oxidation inhibitor of the ester base lubricating oil composition is a dialkyldiphenylamine. These compounds are represented by the formula:

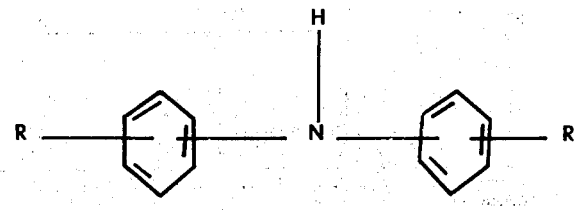

in which the R is an alkyl radical having from about 3 to 12 carbon atoms. Suitable alkylamines include dioctyldiphenylamine, didecyldiphenylamine and similar compounds. The preferred class of dialkyl diphenylamines are those in which R is an alkyl radical having from 8 to 10 carbon atoms. Dooctyldiphenylamine is the preferred compound and the effective concentration is from 0.5 to 2.0 percent.

Another valuable component of an ester base lubricating oil composition is a hydrocarbylphosphate ester, more specifically a trihydrocarbyl phosphate having the formula $(RO)_3PO$ in which R is a hydrocarbyl radical i.e. an alkyl, aryl, alkaryl, cycloalkyl or aralkyl radical or mixture thereof having from 2 to 12 carbon atoms and preferably from 4 to 8 carbon atoms. Effective specific compounds include tricresylphosphate, cresyl diphenyl-phosphate, triphenylphosphate, tributylphosphate, tri(2-ethylhexyl)phosphate and tricyclohexyl phosphate. These compounds are generally effective at a concentration ranging from about 0.5 to 5 weight percent of the lubricant composition.

An optional component of the lubricant is a metal deactivator, which is commonly employed in an ester base lubricating oil composition. An effective metal deactivator is a polyhydroxy-substituted anthraquinone inhibitor represented by the formula:

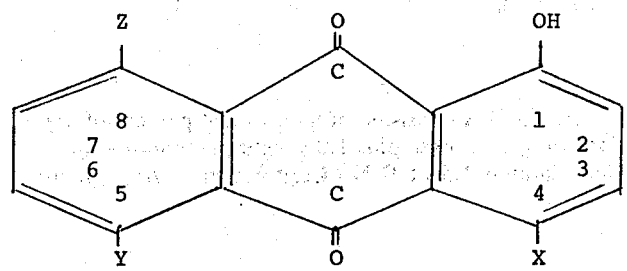

in which X, Y and Z each represent hydrogen or a hydroxyl group and at least one of these is a hydroxyl group. Examples of effective polyhydroxy-substituted anthraquinones include 1,4-dihydroxyanthraquinone, 1,5-dihydroxyanthraquinone, 1,2,4-trihydroxyanthraquinone and 1,2,5,8-tetrahydroxyanthraquinone. In general, this component is employed in a concentration ranging from about 0.04 to 2.0 weight percent of the lubricating oil composition with the preferred concentration being from 0.05 to 0.25 weight percent.

The load carrying properties of lubricants containing trithiocyanurates was determined by preparing oil compositions and subjecting them to load-carrying tests in the Ryder Gear Test. The lubricating oil compositions were also tested for their oxidation and corrosion resistance in the 425°F/48 Hr. Oxidation and Corrosion Test which was conducted in accordance with Standard No. 791a (issued Dec. 31, 1961) except for modifications to conform to Pratt and Whitney 521C Specifications. The bath temperature is maintained at 425°F. ± 1°F. instead of at 250°F. and the test is conducted for a period of 48 hours instead of 168 hours as specified in the original test.

The ester base oil employed in preparing Base Fluids A and B below comprised pentaerythritol containing a minor amount of dipentaerythritol esterified with mixtures of fatty acids. This ester base (Hercules L-39) consisted of a technical grade pentaerythritol ester made from a mixture of carboxylic acids consisting of (mole %).

| | |
|---|---|
| i - $C_5$ | 5 ± 2% |
| i - $C_5$ | 22 ± 5 |
| n - $C_6$ | 21 ± 5 |
| n - $C_7$ | 27 ± 5 |
| n - $C_8$ | 7 ± 3 |
| n - $C_9$ | 18 ± 3 |

This ester base oil had the following physical properties:

| | |
|---|---|
| Viscosity, cs at 210°F. | 5.01 |
| Viscosityy, cs at 100°F. | 25.6 |
| Viscosity, cs at −40PF. | 7005 |
| Viscosity Index | 140 |
| Flash, F | 515 |

Base Fluid A consisted of 95.4 weight percent of the foregoing ester base plus 1.0 weight percent dioctyldiphenylamine, 1.5 wt. % N-(4-tert.octylphenyl)-α-naphthylamine 2.0 wt. % tricresylphosphate, and 0.1 wt. % of quinizarin. This Base Fluid has an average Ryder Gear Test Failure Load of about 2650 ppi.

Base Fluid B was similar to Base Fluid A but contained N-(4-cumylphenyl)-6-cumyl-2-naphthylamine in place of the N-(4-tert. octylphenyl)-α-naphthylamine. This Base Fluid has an average Ryder Gear Test Failure Load of about 2650 ppi.

Base Fluid C is a reference oil used in the U.S. Navy's XAS-2354 specification (Hercolube A) as a comparison oil for evaluating high load oils. According to the U.S. Navy specifications, a high gear load oil passes this test if it exhibits a load carrying capacity of 144% (two runs) or 135% (six run average) over the reference oil.

The results of the Ryder Gear Load Carrying Test and the Oxidation-Corrosion Test are set forth in the table below:

TABLE I

EVALUATION OF DI- AND TRI-(HYDROCARBYLAMMONIUM) TRITHIOCYANURATES

| Run | Base Fluid | Additive & Conc. Wt. % | RYDER GEAR TEST FAILURE LOAD ppi | % Herc. A[1] | 425°F/48 Hr.PWA-521C OXID. CORR TEST WT. Δ, mg/Cm² Cu. | Mg. | TAN Inc. | Kin. Visc. Inc. |
|---|---|---|---|---|---|---|---|---|
| 1 | Base Fluid B | Example I 0.15 | 3185 | 147 | — | — | — | — |
| 2 | Base Fluid B | Example III 0.15 | 3015 | 166 | −0.29 | 0.0 | 0.74 | 23.0 |
| 3 | Base Fluid B | Example II 0.15 | 3460 | 144 | +0.21 | 0.0 | 1.11 | 28.5 |
| 4 | Base Fluid A | Example I 0.30 | 3850 | 184 | — | — | — | — |

[1]Relative rating in percent obtained by running the U.S. Navy reference oil "Base Fluid C" on the front side of the gear set and the test oil on the back side of the same gear set.

The foregoing tests demonstrate the outstanding performance of the novel di- and tri-(hydrocarbylammonium) tri-thiocyanurate for increasing the load-carrying properties of a lubricating oil composition both in the Ryder Gear Load Test and according to the U.S. Navy's load-carrying test. The lubricants have also been shown to provide formulated blends which possess good Oxidation-Corrosion properties.

We claim:

1. A compound of the formula:

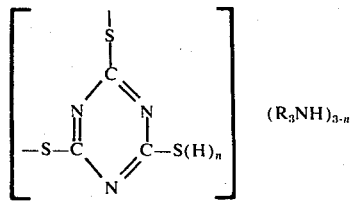

in which R is hydrogen or an alkyl radical having from about 8 to 24 carbon atoms at least one R being an alkyl radical and n has a value of 0 to 1.

2. A compound according to claim 1 in which R is an alkyl radical having from about 11 to 22 carbon atoms.

3. A compound according to claim 1 in which R is a tertiary alkyl radical.

4. The compound tri(t-$C_{18}$-$C_{22}$ alkyl primary ammonium) trithiocyanurate.

5. The compound tri(t-$C_{11}$-$C_{14}$ alkyl primary ammonium trithiocyanurate.

6. The compound di(t-$C_{18}$-$C_{22}$ alkyl primary ammonium trithiocyanurate.

7. The compound di(t-$C_{11}$-$C_{14}$ alkyl primary ammonium trithiocyanurate.

* * * * *